United States Patent [19]

Grudgfield et al.

[11] Patent Number: 4,663,996

[45] Date of Patent: May 12, 1987

[54] LIGHT BULB CHANGING APPARATUS

[76] Inventors: Ross Grudgfield; Melvyn Holmes, both of 167 Little Bloomfield Street, Gunnedah, Australia, 2380

[21] Appl. No.: 690,783

[22] Filed: Jan. 10, 1985

[51] Int. Cl.[4] ..... H01K 3/32

[52] U.S. Cl. ..... 81/53.11; 294/99.1

[58] Field of Search ..... 294/19.1, 19.2, 20, 294/21, 99.1; 81/53.11, 53.12

[56] References Cited

U.S. PATENT DOCUMENTS

| | | | |
|---|---|---|---|
| 431,721 | 7/1890 | Jacobs | 81/53.12 |
| 898,696 | 9/1908 | Southworth | 81/53.11 |
| 1,823,170 | 9/1931 | Schulz | 81/53.11 |
| 2,117,017 | 5/1938 | Chadsey | 81/53.11 |
| 2,243,106 | 5/1941 | Limbert | 81/53.11 |
| 2,526,084 | 10/1950 | Penn | 81/53.11 |
| 2,556,701 | 6/1951 | Mozena | 81/53.11 |
| 2,766,060 | 10/1956 | Fuller | 81/53.11 |

*Primary Examiner*—Johnny D. Cherry

*Attorney, Agent, or Firm*—Townsend and Townsend

[57] ABSTRACT

The present invention discloses a light bulb changing apparatus which is normally mounted on the end of a rod (2) and takes the form of a body (1) having a substantially hemispherical cavity (3). A number of fingers (4) surround the cavity in order to assist in restraining a light bulb engaged with the body such that the hemispherical end of the light bulb is located within the cavity (3). The interior of the cavity permits a twisting force to be applied to the hemispherical end of the light bulb in order to permit it to be removed from, or inserted into, a light fitting.

4 Claims, 4 Drawing Figures

LIGHT BULB CHANGING APPARATUS

The present invention relates to light bulb changing apparatus and, in particular, to light bulb changing apparatus which enables substantially conventional incandescent light bulbs to be changed manually without being held in the hand of an operator.

BACKGROUND ART

Incandescent light bulbs are well known and have a metallic base and a glass envelope with a substantially hemisperical end or tip. Irrespective of whether the base is an Edision-Swan screw thread or a bayonet cap fitting, in order to change the light bulb it is necessary to apply a twisting force to the glass envelope in order to both engage and disengage the light bulb from its fitting.

Many people dislike changing light bulbs of this nature because of the need to grip the glass envelope in the hand. Whilst there is little likelihood of the bulb fracturing, there is some fear of this happening. In addition, the increasingly prevalent use of aluminum instead of brass in the base of the bulb has tended to increase problems caused by the bending or other malfunction of the base. A common fault is that the bond between the glass envelope and the base is broken.

A further problem is that from time to time persons changing such light bulbs are electrocuted owing to a breakdown in the electrical insulation of the bulb and/or the glass envelope fracturing and the person inadvertently coming into contact with the filament of the bulb which is inadvertently energised. A further problem is that most light fittings are in elevated positions and therefore it is necessary to climb upon a ladder, stool or small set of steps in order to reach the light fitting. In view of the above problems, a light bulb changing apparatus has been a desirable piece of equipment for some time and is normally mounted on a long rod in order to permit the operator to change the light bulb without the need to climb steps or the like.

Various types of light bulb changing appartaus are known and those disclosed in Australian Pat. Nos. 291,106 (45908/64) and 498,920 (78891/75) are typical of such arrangements in that they are relatively complex and include a number (usually three) of fingers which grip the glass envelope of the light bulb. Normally the fingers are moveable and are in some way able to be actuated from the (lower) end of the rod used to hold the fingers adjacent and elevated light fitting.

Such apparatus is characterised by being of relatively high mechanical complexity and therefore is not only costly but is also to some extent difficult to use, especially by unskilled labour.

Australian Pat. No. 278,135 (49755/64) discloses another light bulb changing apparatus which like the above described pieces of apparatus is complex to manufacture but grips the light bulb by a different means. In this apparatus the rod is provided with a rubber conical cup which is connected to a small air chamber in which the pressure is able to be either decreased to grip the bulb or increased to release the bulb from the apparatus.

In view of the foregoing it is an object of the present invention to provide an improved light bulb changing apparatus which is not mechanically complex and which is preferably adapted for manufacture by low cost plastics moulding so as to be able to produced at low cost.

DISCLOSURE OF THE INVENTION

According to one aspect of the present invention thereis disclosed a light bulb changing apparatus comprising a body having a rod receptor whereby said body is adapted to be supported at one end of a rod located within said receptor, a substantially hemispherical cavity in said body opening away from the rod receptor and dimensioned to receive the nemispherical end of an incandescent light bulb, and light bulb restraining means arranged around said cavity and protuding beyond said cavity away from said rod receptor to restrain an incandescent bulb within said cavity against movement away from said apparatus, the interior of said cavity permitting a twisting force to be applied to said hemispherical bulb end.

Preferably the interior of the cavity fits the hemispherical bulb end so closely as to at least partially exclude air from between the bulb and the cavity. In addition, the interior surface of the cavity is preferably not smooth thereby permitting frictional transfer of forces between the apparatus and the light bulb. The preferred form of the light bulb restraining means is a plurality of resilient fingers spaced around the cavity.

BRIEF DESCRIPTION OF DRAWINGS

Two embodiments of the present invention will now be described with reference to the drawings in which.

BEST MODE OF CARRYING OUT INVENTION

Figure 1:
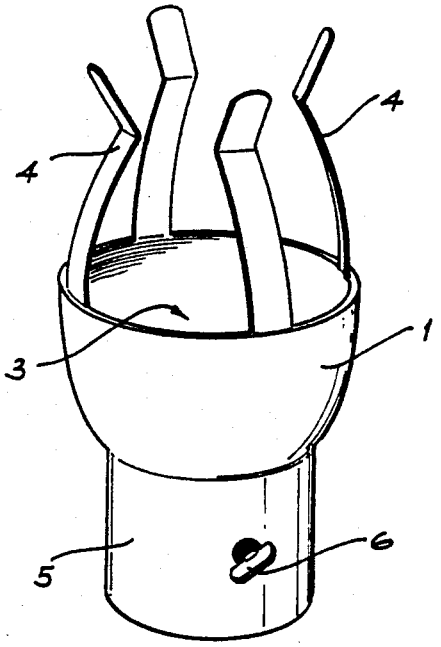
FIG. 1 is a perspective view from the side of the light bulb changing apparatus of a first embodiment.
Figure 2:
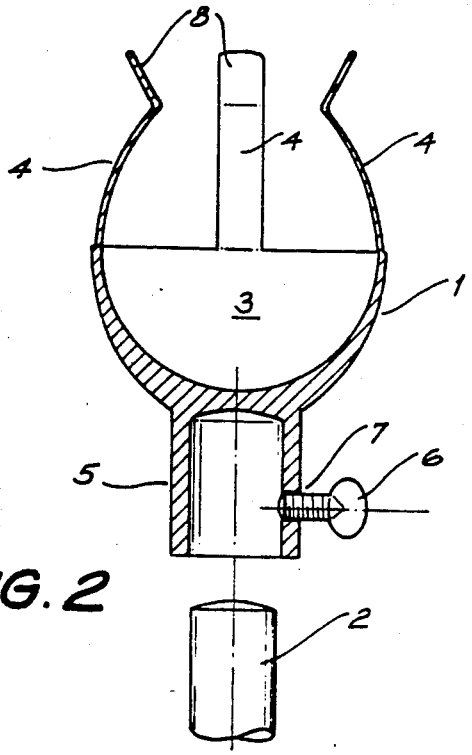
FIG. 2 is a longitudinal sectional exploded schematic view of the apparatus of FIG. 1.

In FIGS. 1 and 2 the light bulb changing apparatus of the first embodiment is illustrated. The apparatus consists of a body 1 which is able to be mounted on a long rod 2 (FIG. 2) in order to enable the light bulb changing apparatus to be used to change bulbs in elevated light fittings. The rod 2 can be any existing piece of equipment such as a broom handle, for example.

The body 1 is moulded from plastics material and provided with a substantially hemispherical caivty 3 having four resilient plastics fingers 4 substantially equally spaced around its circumference. The cavity 3 and its fingers 4 respectively open and protrude in a direction away from a sleeve 5 which is substantially cylindrical, hollow, and open at one end so as to form a rod receptor for the rod 2. A threaded fastener 6 is received in an internally threaded aperture 7 in a side wall of the sleeve 5 so as to permit the body 1 to be releasably secured to the rod 2.

In this embodiment, the fingers 4 have tipe 8 which lie in a circle (not illustrated) of smaller diameter than the diameter of the mouth of the cavity 3. Thus when a light bulb is inserted into the cavity 3 the tips 8 of the fingers 4 are deflected outwardly around the hemispherical end of the light bulb, and then move inwardly so as to enable the fingers 4 to restrain the light bulb and stop it toppling out of the body 1.

An important feature of the preferred embodiment is that the internal surface of the cavity 3 so closely resembles the outer surface of the hemispherical end of the light bulb, that when the end of the light bulb is placed into the cavity 3 air is at least partially excluded from between the end of the light bulb and the interior surface of the cavity 3. It is believed that this exclusion results in air pressure providing a net force tending to push the light bulb into the cavity 3. Certainly, in order to withdraw the light bulb from the cavity 3 a slight force must be overcome and the initial movement of the bulb away from the cavity results in a slight "plopping" noise being heard.

Furthermore, it is also preferred that the interior of the cavity 3 not be provided with a smooth, highly polished surface but rather that the interior surface of the cavity 3 be slightly roughened or have a slightly rough texture. It is believed the surface finish improves the frictional transfer of twisting forces from the body 1 to the light bulb.

Figure 3:
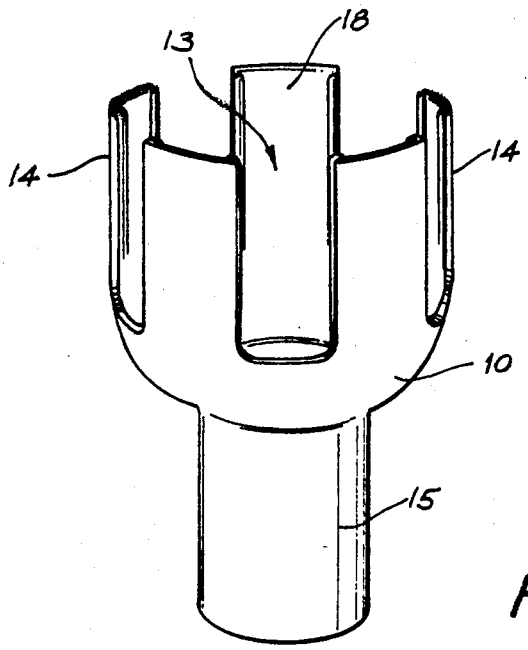
FIG. 3 is a view similar to FIG. 1 but of apparatus of the second embodiment.
Figure 4:
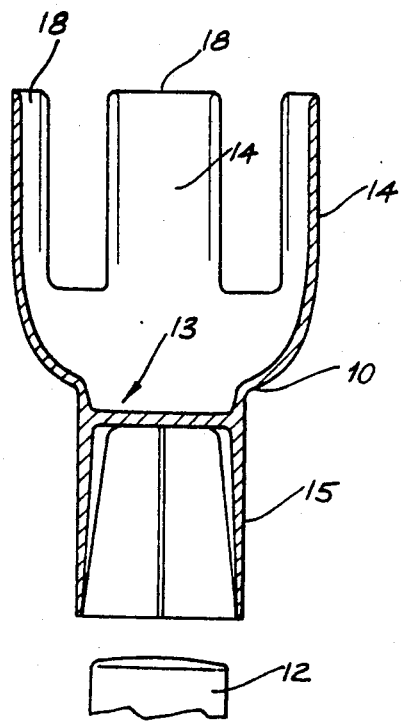
FIG. 4 is a view similar to FIG. 2 but of the apparatus of FIG. 3.

Turning now to FIGS. 3 and 4, the apparatus of the second embodiment is substantially the same as the apparatus of the first embodiment save that the sleeve 15 is not provided with the fastener 6 and instead forms a frictional fit with the upper end of the rod 12. In addition, there are five fingers 14 and the tips 18 of the fingers 14 do not lie inwardly of the remainder of the fingers 14.

It will be appreciated that the fingers 14 of FIGS. 3 and 4 are substantially easier to mould than the fingers 4 of FIGS. 1 and 2 thereby reducing the cost of production of the body of FIGS. 3 and 4. In addition, it has been determined that the arrangement of FIGS. 3 and 4 is equally suitable in restraining a light bulb (not illustrated) within the body 10. In the embodiment of FIGS. 3 and 4 the bulb is able to pivot within the cavity 13 without moving away from the cavity 13, until such time as the tips 18 of the fingers 14 prevent further pivoting of the light bulb in a given direction. Thus although the embodiment of FIGS. 3 and 4 permits the light bulb to tilt to a greater degree than that of the embodiment of FIGS. 1 and 2, this increased tilting is not disadvantageous.

It will be apparent that the apparatus of both embodiments enables incandescent bulbs to be removed from light fittings by exerting a longitudinally directed force along the rod 2 or 12, and then rotating the rod 2 or 12 so as to transmit the rotational forces therefrom to the body 1 or 10 and then, in turn, to the light bulb. Once the light bulb has been released from the light fitting by the turning action, the light bulb can be withdrawn from the fitting merely by withdrawing the rod 2 or 12 and body 1 or 10.

In order to locate a fresh light bulb within a light fitting the procedure is substantially reversed and the restraining fingers 4 or 14 enable a sufficient directional control to be exercised so that the base of the light bulb can be initially engaged with the light fitting. Thereafter longitudinal force exerted on the rod 2 or 12 and the twisting of the rod 2 or 12 and hence the light bulb, are all that are required to complete the insertion of the light bulb. The body 1 or 10 is then moved away from the fixed light bulb in order to withdraw the apparatus from the light fitting.

The foregoing describes only two embodiments of the present invention and modifications, obvious to those skilled in the art, can be made thereto without departing from the scope of the present invention.

We claim:

1. A light bulb changing apparatus, comprising:

a body having a rod receptor which is shaped to receive one end of a rod therein to thereby support body by said rod;

a cavity, said cavity having walls formed to be a substantially hemispherical segment of said body, opening away from said rod receptor and dimensioned to receive the hemispherical end portion of an incandescent light bulb;

a plurality of restraining fingers circumferentially arranged around said walls of said cavity, mutually spaced apart, and protruding beyond said cavity away from said rod receptor to restrain an incandescent bulb within said cavity to prevent movement of the bulb away from said apparatus;

wherein said body and said restraining fingers are fabricated in a single piece from a single moldable material which is substantially rigid;

wherein said cavity has an interior surface a substantial portion of which is dimensioned to exactly correspond without deformation to the hemispherical end of the light bulb; and wherein each of said restraining fingers is substantially longer than it is wide whereby said restraining fingers are relatively resilient in the radial direction.

2. Apparatus as claimed in claim 1, wherein said rod receptor further includes at least one radially directed, internally threaded aperture therethrough which threadably engages and cooperates with an externally threaded fastener to frictionally retain said rod within said rod receptor.

3. Apparatus as claimed in claim 1, wherein said apparatus is molded from plastics material.

4. Apparatus as claimed in claim 1, wherein said rod receptor comprises a sleeve dimension to form a frictional fit with said one end of said rod.

* * * * *